US006857775B1

(12) United States Patent
Wilson

(10) Patent No.: US 6,857,775 B1
(45) Date of Patent: Feb. 22, 2005

(54) TIMEPIECE WITH INTEGRAL MOLDED WRISTBAND

(75) Inventor: Scott Harold Wilson, Portland, OR (US)

(73) Assignee: Nike, Inc., Beaverton, OR (US)

( * ) Notice: Subject to any disclaimer, the term of this patent is extended or adjusted under 35 U.S.C. 154(b) by 389 days.

(21) Appl. No.: 09/986,660

(22) Filed: Nov. 9, 2001

(51) Int. Cl.[7] ..... A44C 5/00; A44C 5/18

(52) U.S. Cl. ..... 368/281; 368/282; 224/164; 224/179

(58) Field of Search ..... 368/281, 282; 224/164–179

(56) References Cited

U.S. PATENT DOCUMENTS

| | | | | |
|---|---|---|---|---|
| 252,444 | A * | 1/1882 | Engel | 63/8 |
| 2,184,060 | A | 12/1939 | Singer | |
| 2,189,096 | A | 2/1940 | Alonge | |
| D. 119,638 | S | 3/1940 | Ornstein | |
| 2,328,785 | A | 9/1943 | Cozart | |
| 2,342,804 | A | 2/1944 | Hiller | |
| 2,344,136 | A | 3/1944 | Dressen | |
| D. 148,671 | S * | 2/1948 | Babin | D11/5 |
| 2,513,892 | A | 7/1950 | Pile | |
| 2,553,089 | A | 5/1951 | Holder | |
| D. 245,766 | S | 9/1977 | Cruse | |
| 4,178,751 | A | 12/1979 | Liautaud | |
| 4,229,936 | A | 10/1980 | Schneider et al. | |
| D. 267,077 | S | 11/1982 | Kabaya | |
| 4,627,739 | A | 12/1986 | Shingo et al. | |
| D. 297,622 | S | 9/1988 | Lee | |
| 4,879,702 | A | 11/1989 | Gardner | |
| 4,958,279 | A * | 9/1990 | Proellochs | 368/282 |
| D. 325,174 | S | 4/1992 | Bulgari | |
| D. 337,739 | S | 7/1993 | Robert-Tissot | |
| D. 340,192 | S | 10/1993 | Robert-Tissot | |
| D. 340,647 | S | 10/1993 | Robert-Tissot | |
| 5,260,915 | A * | 11/1993 | Houlihan | 368/10 |
| D. 356,269 | S | 3/1995 | Milovanovic | |
| D. 361,282 | S | 8/1995 | Bulgari | |
| D. 361,524 | S | 8/1995 | Bulgari | |
| D. 363,893 | S | 11/1995 | Avakian | |
| D. 365,550 | S | 12/1995 | Houlihan | |
| D. 366,036 | S | 1/1996 | Houlihan | |
| 5,638,342 | A | 6/1997 | Kartsotis et al. | |
| D. 388,333 | S | 12/1997 | Wunderman | |

(List continued on next page.)

FOREIGN PATENT DOCUMENTS

| | | |
|---|---|---|
| JP | 11300864 A | 2/1999 |

* cited by examiner

*Primary Examiner*—Vit W. Miska
(74) *Attorney, Agent, or Firm*—Banner & WItcoff, LTD

(57) ABSTRACT

A bracelet-style watch having a case, a wristband formed integral with the case, and three separating element is disclosed. The separating elements, located on the case and wristband, form a space between the timepiece and the wrist. The space permits air to freely enter a substantial portion of an area between the timepiece and the wrist, thereby ventilating and reducing the quantity of perspiration that collects between the timepiece and the wrist.

42 Claims, 3 Drawing Sheets

U.S. PATENT DOCUMENTS

D. 396,651 S 8/1998 Wunderman
D. 398,247 S 9/1998 Dumas
5,812,500 A 9/1998 Webb, Jr.
D. 400,118 S 10/1998 Itzkowitz
D. 404,316 S 1/1999 Azegami et al.
D. 413,070 S 8/1999 Charriol
D. 415,708 S 10/1999 Yanku
D. 418,442 S 1/2000 Yanku
D. 429,168 S 8/2000 Jannard et al.
D. 430,495 S 9/2000 Wunderman
D. 433,342 S 11/2000 Fox
D. 434,333 S 11/2000 Riley et al.
D. 434,674 S 12/2000 Shiraishi
D. 435,461 S 12/2000 So
D. 438,123 S 2/2001 Choi et al.
D. 438,470 S 3/2001 Choi et al.
D. 439,527 S 3/2001 Kennedy
D. 440,885 S 4/2001 Streltsov
6,216,490 B1 4/2001 Radley-Smith
D. 441,663 S 5/2001 Streltsov
D. 446,461 S 8/2001 Wunderman
D. 447,426 S 9/2001 Jannard et al.
D. 447,700 S 9/2001 Glauser
D. 448,682 S 10/2001 Sato
D. 449,997 S 11/2001 Blauner et al.
D. 450,600 S 11/2001 Scarinzi
D. 451,036 S 11/2001 Zuckerman et al.
D. 466,488 S * 12/2002 Wada et al. ..... D14/138

* cited by examiner

TIMEPIECE WITH INTEGRAL MOLDED WRISTBAND

BACKGROUND OF THE INVENTION

1. Field of the Invention

The present invention relates to a wrist-worn timepiece. The invention concerns, more particularly, a wrist-worn timepiece having a configuration that permits air to circulate between the timepiece and the wrist.

2. Description of Background Art

A conventional wrist-worn timepiece, typically referred to as a watch, may be designed to perform both aesthetically and functionally during a variety of activities. Dress watches, for example, are designed to have a fashionable appearance that is appropriate for business or social gatherings. Diving watches are designed to be particularly durable and to withstand the high pressure environments often encountered by deep-sea divers. Sport watches are lightweight and worn by athletes during training or competitions.

The components of a conventional watch typically include a timing element, a case, and a wristband. The timing element is located within the case and functions to track the time and display the time for a wearer or another individual. The case protects the timing element and often includes a transparent face for viewing a time display on the timing element. The wristband extends from opposite sides of the case and secures the case and timing element to a wrist of the wearer.

Although the majority of watches include a timing element, a case, and a wristband, modern watch designs include many variations upon the components. The timing element, for example, may be mechanical, electrical, or a combination of mechanical and electrical. The wristband may have a clasp that secures the watch to the wrist or an open, bracelet-like configuration. Furthermore, the materials that form the various components may include both polymers and metals.

Sport watches are often used during athletic activities where they may encounter prolonged exposure to perspiration. Accordingly, sport watches may include variations that counter the negative effects of perspiration. For example, perspiration that collects between the watch and the wrist may cause discomfort to the wearer. U.S. Pat. No. 5,812,500 to Webb, Jr. discloses a watch that is releasably-attached to a cloth-like wristband in order to absorb perspiration. U.S. Pat. No. 2,184,060 to H. Singer discloses a wristband with cushioning members that permit air to circulate between a limited portion of the wrist and the wristband. See also U.S. Pat. No. 2,342,804 to A. W. Hiller; U.S. Pat. No. 2,328,785 to W. T. Cozart; and U.S. Pat. No. 5,638,342 to Kartsotis et al.

BRIEF SUMMARY OF THE INVENTION

The invention is a timepiece having a case, a wristband, and at least a first separating element. The case includes a timing element for tracking and displaying time. The wristband, which is formed integral with the case, is a bracelet-style wristband and secures the timepiece to a wrist of a wearer. The wristband includes a first extension and a second extension that extend from opposite sides of the case. The first separating element is located on the wristband and adjacent to the wrist and forms at least one separation between the wristband and the wrist, the separation permitting air to ventilate an area between the wristband and the wrist.

In addition to the first separating element, which may be located on an end of the first extension, the timepiece also includes a second separating element located on an end of the second extension and a third separating element located on the case. Together, the three separating elements form a three-point contact with the wrist that prevents the case and wristband from making substantial contact with the wrist. In essence, the three separating elements form a separation between the timepiece and the wrist that facilitates ventilation by permitting the entry of air.

The separating elements may have a smooth surface that contacts the wrist. Advantageously, however, the separating elements may also have a textured surface that permits air to circulate between the separating elements and the wrist. The added circulation from the texturing further advances the ventilated properties of the timepiece.

The first and second extensions, in conjunction with the separating elements, are configured to secure the timepiece to the wrist without the necessity of a clasp. In general, the extensions flex outward when the timepiece is positioned on the wrist and place an inward pressure on the separating elements. The separating elements may be formed of a material that has relatively high friction properties when in contact with the wrist. Accordingly, significant movement of the timepiece is restricted by the inward pressure of the extensions and the friction properties of the separating elements.

The various advantages and features of novelty that characterize the present invention are pointed out with particularity in the appended claims. To gain an improved understanding of the advantages and features of novelty that characterize the present invention, however, reference should be made to the descriptive matter and accompanying drawings which describe and illustrate preferred embodiments of the invention.

DETAILED DESCRIPTION OF THE INVENTION

Referring to the figures, wherein like numerals indicate like elements, a timepiece in accordance with the present invention is disclosed. Timepiece 100, depicted in FIGS. 1-4, is a sport watch intended to be used during athletic training or competition. One skilled in the art will recognize that the concepts disclosed below are applicable to a wide range of watches, in addition to sport watches.

Figure 1:
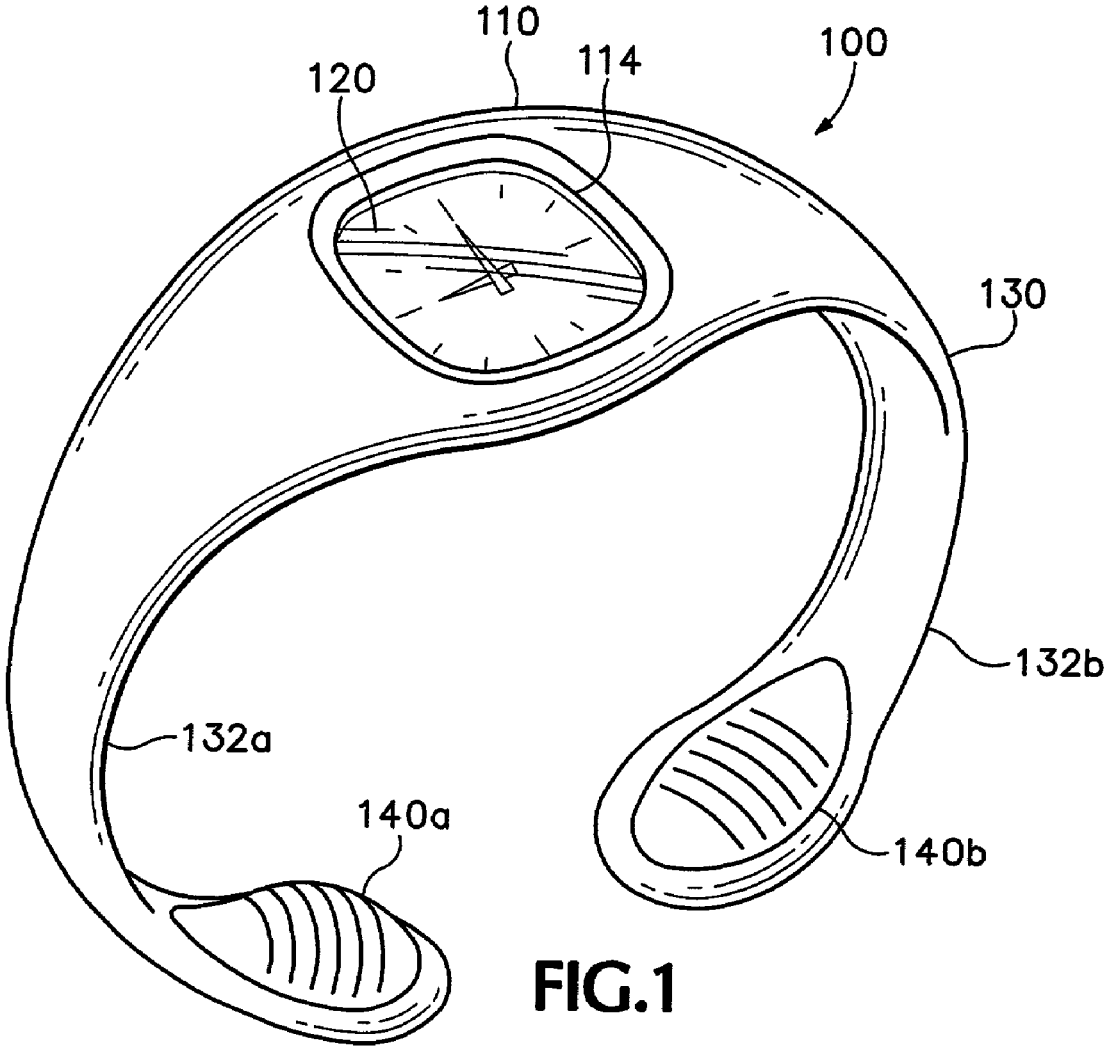
FIG. 1 is a perspective view of a timepiece in accordance with the present invention.
Figure 2:
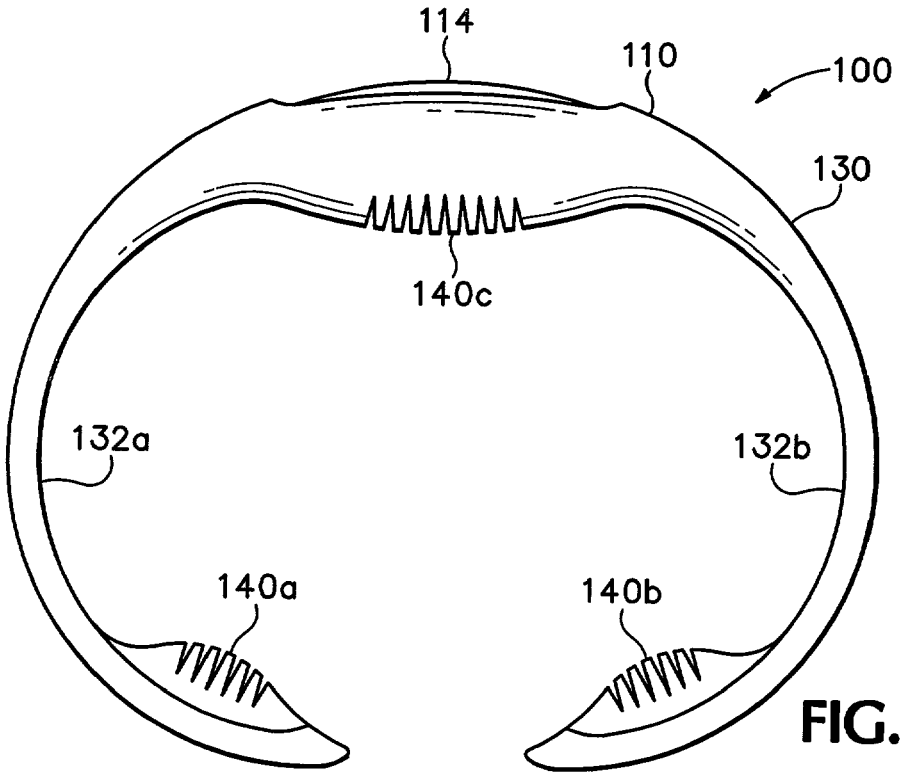
FIG. 2 is an elevational of the timepiece depicted in FIG. 1.
Figure 3:
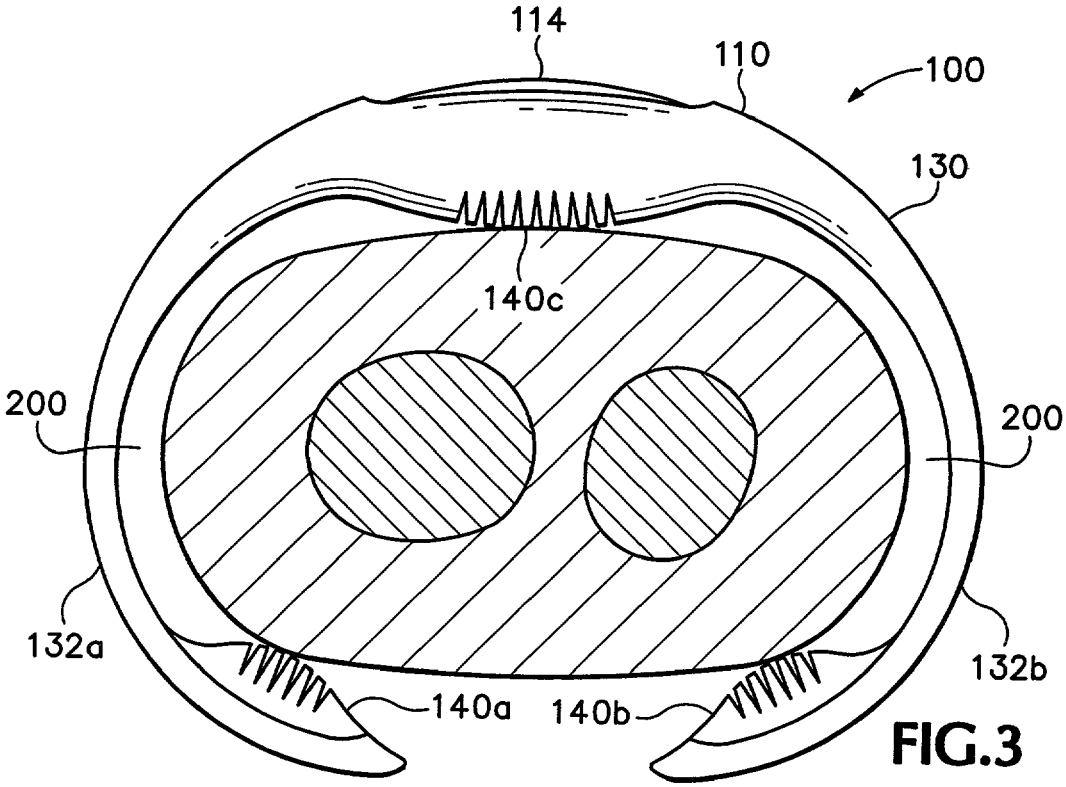
FIG. 3 is an elevational view, as depicted in FIG. 2, depicting a cross-section of a wrist encompassed by the timepiece.

Timepiece 100 includes a case 110, a timing element 120 located within case 110, a wristband 130, and three separating elements 140. In general, the various components are configured such that separating elements 140 form the primary points of contact between timepiece 100 and a wrist of a wearer. As best depicted in FIG. 3, separating elements 140 are positioned such that a separation 200 is formed between the wrist (depicted in cross-section) and other portions of timepiece 100, including case 110 and wristband 130.

In a conventional watch, the case and wristband typically contact the wrist around substantially all of the circumference of the wrist. During exercise, other strenuous activities, or long periods of wear, perspiration may collect between the watch and the wrist. Separation 200, however, which is formed by separating elements 140, permits air to freely enter a substantial portion of the area between timepiece 100 and the wrist, thereby ventilating and reducing the quantity of perspiration that collects between timepiece 100 and the wrist.

Case 110 may be formed to have any practical shape ranging from round to angular. The primary purposes of case 110 are to receive timing element 120 and provides timing element 120 with a protective housing. Accordingly, case 110 includes a recess 112 configured to receive timing element 120. In order to protect timing element 120, case 110 or timing element 120 may include a transparent cover 114 that permits the wearer and other individuals to view the time displayed by time element 120.

Figure 4:
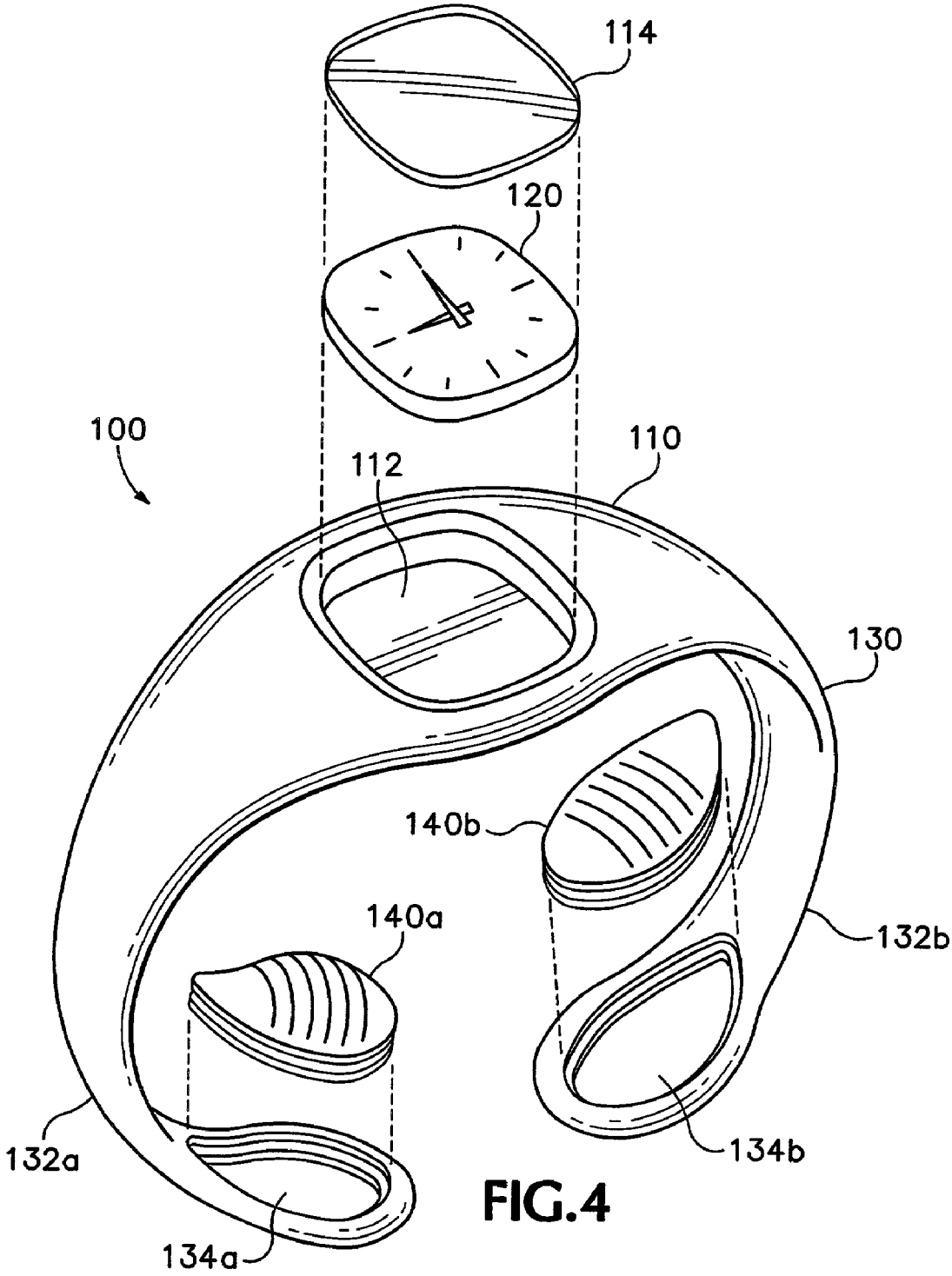
FIG. 4 is an exploded view of the timepiece as depicted in FIG. 1.

The primary purpose of timing element 120 is to track and display time. In FIGS. 3 and 4, timing element 120 is depicted as having an analog display. Alternatively, timing element 120 may display time in a digital manner or in both an analog and a digital manner. Timing element 120 may also perform one or more alternate functions in addition to tracking and displaying time. The alternate functions include, for example, performing as a stopwatch, monitoring the heart rate of the wearer, calculating distance traveled, functioning as a calculator, providing audible signals to pace the running speed of the wearer, gauging the temperature of surrounding air, displaying altitude, and functioning as a global positioning system.

Wristband 130 is formed integral with case 110 and includes two extensions 132 that extend from opposite sides of case 110. Alternatively, case 110 and wristband 130 may be formed separately. Extensions 132 may have a variable thickness to facilitate greater bending in specific areas. For example, extensions 132 may be designed with greater thickness in portions adjacent to case 110 and separating elements 140 and lesser thickness between case 110 and separating elements 140 to facilitate bending in mid-portions of extensions 132. Each extension 132 wraps around opposite sides of the wrist to secure timepiece 100 to the wearer. Conventional watches often include a clasp that connects the two extensions of the wristband. Although timepiece 100 may include such a clasp, wristband 130 is configured to remain securely positioned on the wrist without a clasp. Timepieces that do not include a clasp, but securely attach to the wrist using a wristband formed of two semi-rigid extensions, are referred to as having a bracelet-style wristband for purposes of the present discussion. U.S. Pat. No. 2,189,096 to A. Alonge; U.S. Pat. No. 2,553,089 to W. R. Holder; U.S. Pat. No. 4,627,739 to Shingo et al.; U.S. Pat. No. 4,879,702 to Gardner; and U.S. Pat. No. 6,216,490 to Radley-Smith disclose examples of bracelet-style wristbands.

The material chosen for case 110 and wristband 130 should be durable and have a pliability that permits the wearer to separate extensions 132 and place timepiece 100 on the wrist. In addition, the material should have sufficient rigidity to ensure that timepiece 100 then remains securely positioned on the wrist. Suitable materials for case 110 and wristband 130 include polymers such as nylon, TPU, TPR, polycarbonate, and polyester. Another suitable material is XYLEX, a polyester-polycarbonate blend manufactured by General Electric Plastics, located at One Plastics Avenue in Pittsfield, Mass. In addition polymer materials, case 110 and wristband 130 may be formed from metals, including stainless steel, aluminum, titanium, or the like.

The space or distance between the ends of extensions 132 is a relevant consideration when determining the ease with which timepiece 100 may be placed upon the wrist or determining whether timepiece 100 will remain securely positioned following placement upon the wrist. The space, when timepiece 100 is in a natural, unstretched configuration, should fall within the range of 5 to 75 millimeters, but may be between 12 and 50 millimeters. If a series of timepieces 100 are made for differing wrist sizes, the space may vary depending upon the wrist size for which a specific timepiece 100 is designed. For example, the distance across the space when timepiece 100 is in a natural, unstretched configuration may be 12.5 millimeters for a small size watch, 13.25 millimeters for a medium size watch, and 16.5 millimeters for a large size watch.

Separating elements 140 are located on the portions of case 110 and wristband 130 that lie adjacent to the wrist. The primary functions of separating elements 140 are to contact the wrist and form separation 200 between timepiece 100 and the wrist. As noted, separation 200 permits air to freely enter the area between timepiece 100 and the wrist, thereby ventilating and reducing the quantity of perspiration that collects between timepiece 100 and the wrist. Accordingly, separating elements should be positioned such that separation 200 is formed around substantially the entire circumference of the wrist. In one configuration that forms a sufficient separation 200, the various separating elements 140 may be positioned, as in FIG. 2, such that separating element 140*a* is located adjacent an end of extension 130*a* and contacts a lower portion of the wrist; separating element 140*b* is located adjacent an end of extension 130*b* and also contacts the lower portion of the wrist; and separating element 140*c* is located on case 110 and contacts an upper portion of the wrist. In addition to forming separation 200, separating elements 140 enhance the fit of timepiece 100 and ensure that case 110 and wristband 130 securely grip the wrist, thereby securely positioning timepiece 100.

In the positions disclosed above, separating elements 140 form a three-point contact with the wrist. In further embodiments, a greater or lesser number of separating elements 140 may be used. The three-point contact, however, ensures that separation 200 is formed between timepiece 100 and the wrist, but also limits the total area of contact between timepiece 100 and the wrist to the area of the three separating elements 140. Five separating elements 140, for example, would increase the area of contact, thereby eliminating a portion of the benefit gained from separation 200.

Separating elements 140 may be formed integral with case 110 and wristband 130. Alternatively, separating elements 140 may be discrete elements that are formed separately and subsequently attached to case 110 and wristband 130. As depicted in FIGS. 1-4, separating elements 140*a* and 140*b* are formed separately and attached to apertures 134 formed in the ends of extensions 132. Separating element 140*c*, however, is formed integral with case 110. In addition, separating elements 140 may be formed with a smooth surface that contacts the wrist or a textured surface, potentially formed by indentations, that permits air to pass between portions of separating elements 140 and the wrist.

In order to ensure secure positioning of timepiece 100, the wrist should have greater dimensions than the area interior to separating elements 140 when timepiece 100 is not being worn. Under these conditions, the wrist exerts an outward force on separating elements 140*a* and 140*b* when timepiece 100 is worn. The outward force, consequently, induces extensions 132 to flex outward, thereby maintaining separation 200 between extensions 132 and the wrist. Similarly, separating elements 140 exert an equal, inward force on the wrist due to the flexion in extensions 130. The wrist, however, is formed of flesh and has a tendency to yield to inward forces. Accordingly, separating elements 140 may have a tendency to press into the wrist, thereby reducing separation 200 between timepiece 100 and the wrist. To prevent separating elements 140 from being engulfed by the wrist, separating elements 140 should be designed to have sufficient height to overcome the tendency of the wrist to yield inward.

The material that forms separating elements 140 should have sufficient rigidity to resist significant deformation when making contact with the wrist. In addition, separating elements 140 may benefit from a material that has relatively high friction properties when contacting the wrist, especially when the wrist is damp from perspiration, such as silicone.

The present invention is disclosed above and in the accompanying drawings with reference to a variety of preferred embodiments. The purpose served by disclosure of the preferred embodiments, however, is to provide an example of the various aspects embodied in the invention, not to limit the scope of the invention. One skilled in the art will recognize that numerous variations and modifications may be made to the preferred embodiments without departing from the scope of the present invention, as defined by the appended claims.

That which is claimed is:

1. A timepiece comprising:

a case that includes a timing element for displaying time;

a bracelet-style wristband formed as a one-piece element with said case for securing said timepiece to a wrist of a wearer, said wristband including a first extension and a second extension that extend from opposite sides of said case; and at least a first separating element located on said wristband and adjacent to the wrist, said first separating element forming at least one separation between said wristband and the wrist, said separation permitting air to ventilate an area between said wristband and the wrist.

2. The timepiece of claim 1, wherein said wristband is formed integral with said case.

3. The timepiece of claim 1, wherein said first separating element is located on said first extension and a second separating element is located on said second extension, said first separating element forming a first separation between said first extension and the wrist, said second separating element forming a second separation between said second extension and the wrist.

4. The timepiece of claim 3, wherein said first separating element is located adjacent an end of said first extension and opposite said case, and said second separating element is located adjacent an end of said second extension and opposite said case, said first separating element and said second separating element contacting a lower portion of the wrist.

5. The timepiece of claim 3, wherein said first separating element and said second separating element are formed separate from said wristband.

6. The timepiece of claim 5, wherein said first separating element and said second separating element are formed of silicone.

7. The timepiece of claim 3, wherein said first and said second separating elements are formed integral with said wristband.

8. The timepiece of claim 3, wherein a third separating element is located on said case, said third said separating element forming a third separation between said case and the wrist.

9. The timepiece of claim 8, wherein said first separation, said second separation, and said third separation extend substantially around a circumference of the wrist.

10. The timepiece of claim 8, wherein at least one of said separating elements includes a textured surface positioned to contact the wrist.

11. The timepiece of claim 10, wherein said textured surface includes a series of indentations.

12. The timepiece of claim 8, wherein said third separating element is formed integral with said case.

13. The timepiece of claim 8, wherein said first separating element, said second separating element, and said third separating element form a three-point contact with said wrist, said three-point contact preventing said case and said wristband from making substantial contact with the wrist.

14. A timepiece comprising:

a case that includes a timing element for displaying time;

a bracelet-style wristband formed as a one-piece element with said case for securing said timepiece to a wrist of a wearer, said wristband including a first extension and a second extension extending from opposite sides of said case; and a first separating element located on said first extension and adjacent the wrist, a second separating element located on said second extension and adjacent to the wrist, and a third separating element located on said case and adjacent to the wrist, said separating elements forming at least one separation between said timepiece and the wrist, said at least one separation permitting air to ventilate an area between said timepiece and the wrist.

15. The timepiece of claim 14, wherein said first separating element is located adjacent an end of said first extension and opposite said case, and said second separating element is located adjacent an end of said second extension and opposite said case, said first separating element and said second separating element contacting a lower portion of the wrist.

16. The timepiece of claim 14, wherein said first separating element and said second separating element are formed separate from said wristband, and said third separating element is formed integral with said case.

17. The timepiece of claim 16, wherein said first separating element and said second separating element are formed of silicone.

18. The timepiece of claim 14, wherein said first and said second separating elements are formed integral with said wristband, and said third separating element is formed integral with said case.

19. The timepiece of claim 14, wherein said at least one separation extends substantially around a circumference of the wrist.

20. The timepiece of claim 14, wherein said first separating element, said second separating element, and said third separating element form a three-point contact with said wrist, said three-point contact preventing said case and said wristband from making substantial contact with the wrist.

21. The timepiece of claim 15, wherein at least one of said separating elements includes a textured surface positioned to contact the wrist.

22. The timepiece of claim 21, wherein said textured surface includes a series of indentations.

23. A timepiece comprising:

a case that includes a timing element for displaying time;

a bracelet-style wristband formed as a one-piece element with said case for securing said timepiece to a wrist of a wearer, said wristband including a first extension and a second extension extending from opposite sides of said case; and a first separating element located on an end of said first extension and adjacent to a lower portion of the wrist, a second separating element located on an end of said second extension and adjacent to the lower portion of the wrist, and a third separating element located on said case and adjacent to an upper portion of the wrist, said separating elements forming at least one separation between said timepiece and the wrist, said at least one separation permitting air to ventilate an area between said timepiece and the wrist.

24. The timepiece of claim 23, wherein said first separating element and said second separating element are formed separate from said wristband, and said third separating element is formed integral with said case.

25. The timepiece of claim 24, wherein said first separating element and said second separating element are formed of silicone.

26. The timepiece of claim 25, wherein said at least one separation extends substantially around a circumference of the wrist.

27. The timepiece of claim 23, wherein said first separating element, said second separating element, and said third separating element form a three-point contact with the wrist, said three-point contact preventing said case and said wristband from making substantial contact with the wrist.

28. The timepiece of claim 23, wherein at least one of said separating elements includes a textured surface positioned to contact the wrist, said textured surface including a series of indentations.

29. A timepiece comprising:

a case that includes a timing element for displaying time; and a wristband formed as a one-piece element with said case that includes a pair of arcurate extensions protruding from side portions of said case, said extensions being configured to extend partially around a wrist of a wearer and form a space between ends of said extensions, said ends being located opposite said case and said space being within the range of 5 to 60 millimeters when said wristband is in an unstretched configuration, and said ends each include a separating element that forms a separation between said wristband and the wrist, said separation permitting air to ventilate an area between said wristband and the wrist.

30. The timepiece of claim 29, wherein said space is in the range of 12 to 50 millimeters.

31. The timepiece of claim 29, wherein said space is in the range of 12.5 to 16.5 millimeters.

32. The timepiece of claim 29, wherein said case and said wristband are formed of a polymeric material.

33. The timepiece of claim 29, wherein said separating elements are formed of silicone.

34. The timepiece of claim 29, wherein said separating elements include a textured surface positioned to contact the wrist.

35. The timepiece of claim 29, wherein said case includes another separating element that forms another separation between said wristband and the wrist.

36. A timepiece comprising:

a case that includes a timing element for displaying time; and a wristband formed as a one-piece element with said case, said wristband having a pair of arcurate extensions protruding from side portions of said case, said extensions being configured to extend at least partially around a wrist of a wearer, said wristband including at least a first portion shaped to form a separation between said wristband and a wrist of a wearer to ventilate an area of the wrist located adjacent said separation.

37. The timepiece of claim 36, wherein said extensions include ends located opposite said case, said ends defining a space between said extensions.

38. The timepiece of claim 37, wherein said space is within the range of 5 to 60 millimeters when said wristband is in an unstretched configuration.

39. The timepiece of claim 37, wherein said space is in the range of 12 to 50 millimeters.

40. The timepiece of claim 37, wherein said space is in the range of 12.5 to 16.5 millimeters.

41. The timepiece of claim 37, wherein said first portion is a first separating element located on a first of said ends and positioned between said first of said ends and the wrist.

42. The timepiece of claim 41, wherein a second separating element is located on a second of said ends and positioned between said second of said ends and the wrist.

* * * * *